United States Patent [19]

Binks

[11] Patent Number: 4,867,094

[45] Date of Patent: Sep. 19, 1989

[54] FLOTATION SYSTEM

[76] Inventor: David N. Binks, 27 Byre Avenue, Somerton Park, Australia

[21] Appl. No.: 87,764

[22] Filed: Aug. 21, 1987

[30] Foreign Application Priority Data

Aug. 22, 1986 [GB] United Kingdom ..... 8620445

[51] Int. Cl.[4] ..... B63B 3/00

[52] U.S. Cl. ..... 114/359; 114/69; 425/470; 264/258; 249/63

[58] Field of Search ..... 114/343, 347, 355, 357, 114/359, 360, 361, 250, 255; 249/64, 65, 314; 425/389, 405 R, 451.9, DIG. 238; 264/258

[56] References Cited

U.S. PATENT DOCUMENTS

| | | | |
|---|---|---|---|
| 3,492,392 | 1/1970 | Kasamatsu et al. | 264/258 |
| 3,662,438 | 5/1972 | Koyama | 249/63 |
| 3,840,319 | 10/1974 | Rhoda | 425/470 |
| 4,021,874 | 5/1977 | Alter et al. | 114/357 |
| 4,413,583 | 11/1983 | Elling et al. | 114/360 |

FOREIGN PATENT DOCUMENTS

| | | | |
|---|---|---|---|
| 053413483 | 10/1985 | Fed. Rep. of Germany . | |
| 2497760 | 1/1981 | France . | |
| 2517620 | 12/1981 | France . | |
| 662792 | 4/1964 | Italy | 114/357 |
| 22271 | 7/1913 | United Kingdom . | |
| 15694 | 7/1915 | United Kingdom . | |
| 285774 | 2/1928 | United Kingdom . | |

*Primary Examiner*—Joseph F. Peters, Jr.
*Assistant Examiner*—Jesûs D. Sotelo
*Attorney, Agent, or Firm*—Bacon & Thomas

[57] ABSTRACT

A method of making a boat comprises moulding a hull (6) with an external longitudinal recess (7), securing a folded inflatable bag (8) within the recess, and fitting a cover (9) into position over the recess such that it can be blown clear thereof when the bag is inflated to provide buoyancy during an emergency.

9 Claims, 3 Drawing Sheets

FLOTATION SYSTEM

BACKGROUND OF THE INVENTION

1. Field of the Invention

The invention relates to a flotation system for a boat having a moulded hull to provide it with buoyancy during an emergency.

2. Description of the Related Art

In the past the crews of yachts or some motor-boats have relied on a life raft for survival at sea when their vessel sinks. In rough conditions when disasters are most likely life rafts have proved far from ideal and there have therefore been other systems intended to save the vessel itself and thereby also to save the crew.

One such system has been to fill certain sections of the vessel with foam so that it will float in a semi-submerged state. This, however, is only practical in quite small vessels as the foam necessary to float an ocean going craft is such that too much essential space is lost. Another system is the use of internal buoyancy bags which can be inflated when necessary, but this has the disadvantage that the bags have been high in the vessel so that the water level in the cabin of the stricken vessel precludes the crew from continuing to live down below. A further approach has been the attachment of inflatable flotation bags to the outside of the vessel and in many ways this is a better solution as the bags can be positioned so that the vessel will float at somewhere near its correct waterline. Additional stability is given because the flotation bags are outboard and the inside of the vessel is unobstructed. However, the protrusion of the folded bags on the outside of the vessel has been unacceptable for most craft, particularly yachts, and furthermore the bags have been very susceptible to damage.

SUMMARY OF THE INVENTION

Viewed from a first aspect the invention provides a method of making a boat, comprising moulding a hull with an external longitudinal recess, securing a folded inflatable bag within the recess, and fitting a cover into position over the recess such that it can be blown clear thereof when the bag is inflated to provide buoyancy during an emergency.

Viewed from a second aspect the invention provides a boat having a moulded hull in which an external longitudinal recess is formed during moulding, a folded inflatable bag secured within the recess, and a cover fitted over the recess and arranged to be blown clear thereof when the bag is inflated to provide buoyancy during an emergency.

With such arrangements, the cover can maintain the normal external shape of the hull without any protrusion while also protecting the folded bag from damage during normal service of the boat. Thus the system is unobtrusive during normal use but can save the boat sinking in the event of an emergency such as a breach in the hull. Furthermore the recess has the effect of producing a stringer along the hull which will add to its rigidity and strength.

In general, a longitudinal recess will be provided on each side of the hull and will be located such that when the inflatable bags in the recesses are inflated they provide good stability to the whole craft and float it at a level as close as possible to its original waterline. This would allow the vessel to continue e.g. sailing to port, although more slowly, and would also enable living below deck to continue giving the crew protection and access to the vessel's stores, water, instruments, equipment etc. The crew would also have the opportunity to repair any breach in the hull and to pump the vessel dry.

Although it might be possible to use a hull mould having a permanent recess forming portion, it is envisaged that the method of the invention could be used by a builder of any conventional moulded e.g. fibreglass hulls without expensive or permanent changes to existing equipment. Thus viewed from a further aspect, the invention provides a recess forming mould adapted to be removably secured on the inside face of a hull mould to provide the desired shape for moulding a hull with an external recess.

Such a removable recess forming mould is of great benefit to a boat builder using a conventional hull mould since it allows the option of whether or not to form the external recess. The recess forming mould generally will be re-usable and longitudinally flexible so as to adapt to a variety of different longitudinal shapes of hull mould, but will be rigid enough to prevent distortion during the moulding process. The recess forming mould might take any convenient shape, but in a preferred embodiment it is arcuate in transverse section and has two spaced and generally parallel longitudinal lugs for removable attachment to the hull mould, the lugs being sufficiently longitudinally flexible to adapt to the longitudinal shape of the hull mould and being flexibly connected to the main body of the recess forming mould such that they can angle themselves to adapt to the transverse shape of the hull mould.

Attachment of the recess forming mould to the hull mould might be by means of a contact glue or film. A recess forming mould might itself form a complete longitudinal recess, but preferably separate end cap moulds are provided for use at each longitudinal end of the main recess forming mould. Recess forming moulds would generally be available in a variety of sizes and lengths to suit varying sized vessels. For example, one size would suit most vessels to 5 tonnes, another to 10 tonnes and so on.

The shape of the longitudinal recess in the hull might be standardized to the extent that the cover for the recess could be made separately to standard specifications. Preferably however, the cover is moulded using the same hull mould as is used for the hull, thereby ensuring that the cover takes the exact external shape that the hull would have had if no recess was to be formed. This can be done by removably securing a pair of cover edge moulds on the inside face of a hull mould at a spacing corresponding to the width of the recess forming mould, the cover edge moulds being shaped such that the moulded cover will fit removably within the recess.

A flexible spacer, e.g. of fabric, may be temporarily secured to the cover edge moulds to ensure that they are correctly spaced apart to the width of the recess forming mould. Alternatively the recess forming mould is first attached to the hull mould by means of an adhesive glue or film placed at intervals just sufficiently to hold the recess forming mould in position. The cover edge moulds are thus positioned firmly against the recess forming mould on each side thereof and secured to the hull mould using an adhesive glue or film. Once the cover edge strips have been positioned, the recess forming mould is removed by springing it out from between the cover edge moulds. It may then be necessary firmly to press down the inner portions of the cover edge moulds which may have lifted a little when removing the recess forming mould.

In general, the shapes of the recess forming and cover edge moulds will be designed such that the cover clips into position in the recess and can be replaced each time it is removed. This would allow the inflatable bag to be checked periodically by expanding the bag to remove the cover and then after checking re-folding it and replacing the cover. Thus routine bag inspections can be made without any great difficulty or expense in the same way that life rafts are conventionally checked. One preferred way of achieving the removable fit is to form each longitudinal edge of the cover as an inwardly directed flange angled to cooperate with the respective edge portion of the recess such that the cover fits forcibly into the recess. Such a fit can be achieved by appropriate shaping of the recess forming mould and the cover edge moulds.

The cover need not supply any structural strength to the hull and therefore need not be as thick as the hull itself would have been in the same area. In fact it is preferable that the cover is sufficiently thin to make it slightly flexible and thus assist in fitting. When the cover is in position, its edges will generally be sealed with a suitable sealant, such as a silicone sealer. Once installed and sealed, the cover should be sufficiently rigid to withstand the normal blows which the vessel may receive during service. During an emergency, however, the bag can be inflated to expand and force the cover from the recess, thereby allowing the bag to come out and expand fully. It may be desired to attach the cover to a safety line to prevent it being lost in the event of inflation at sea.

The inflatable bag might be formed with an attachment flange to enable it to be secured to the hull within the recess. For example, a longitudinal attach-ment flange might be bolted to the hull with a pair of strips e.g. of metal acting as washers, one on the attachment flange and the other on the inside of the hull. Such a securing arrangement can provide an even distribution of the lifting forces exerted by the inflated bag on the hull. The inside of the securing arrangement will generally be sealed over with moulding material e.g. fibreglass to seal the recess from the inside of the hull. The bag can be made of any suitable materials such as, for example, synthetic rubber with fabric reinforcement, additional reinforcement being provided for any attachment flange. The bag might be compartmented if desired to provide additional safety. Once attached in the recess, the folded bag might be held in position by lightweight straps fastened with tabs adapted to separate when the bag is inflated.

The bag, or each compartment thereof, will generally communicate with a source of gas within the hull. This can be achieved by a threaded inflation tube projecting form the bag and passing through a hole in the hull where a sealing washer and nut can seal and secure the tube in position. The source of gas might be a compressed gas or chemicals which can be activated to form a gas.

It will thus be appreciated from the foregoing that a builder of conventional hulls can be provided with a kit of parts which enable him to incorporate a flotation system into an otherwise standard hull. The invention therefore also provides a kit of parts for carrying out the methods discussed above, the kit comprising a mould for forming an external longitudinal recess in a hull, an inflatable bag adapted to be secured in said recess, and a cover or a mould for forming a cover adapted to fit over said recess. The parts of the kit may each optionally include the various features described herein.

DESCRIPTION OF THE PREFERRED EMBODIMENTS

Figure 1:
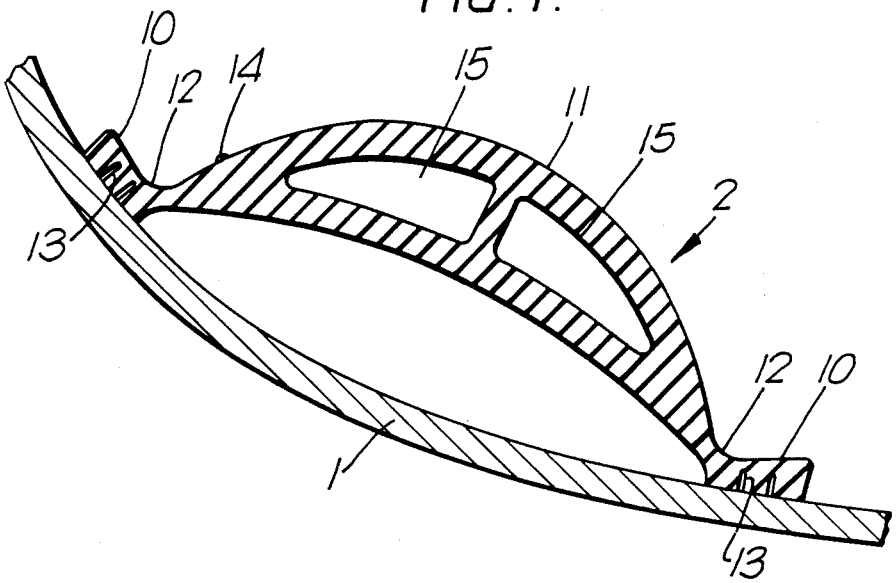
FIG. 1 is a tranverse section through a hull mould and a recess forming mould.
Figure 2:
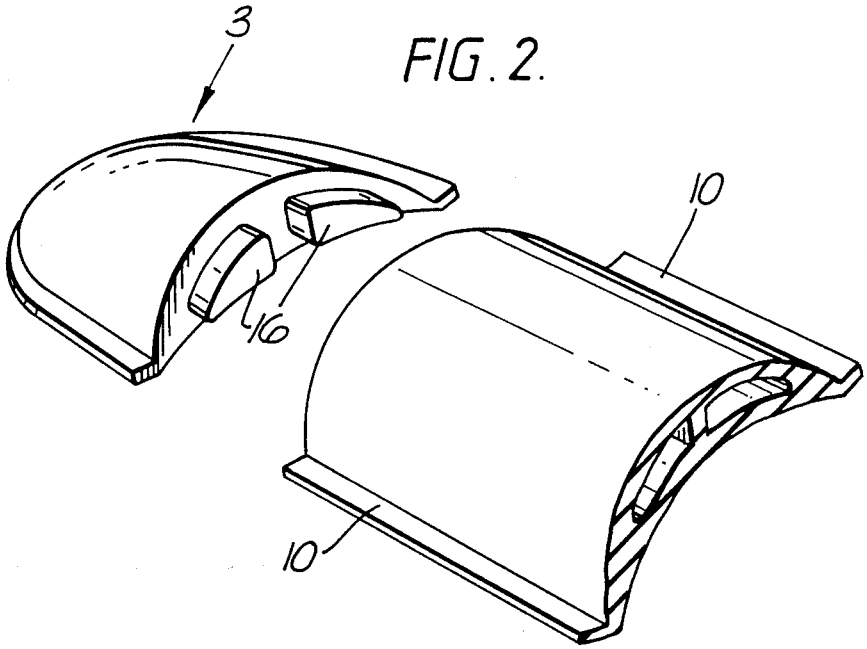
FIG. 2 is a perspective view of the recess forming mould and an associated end cap mould.
Figure 3:
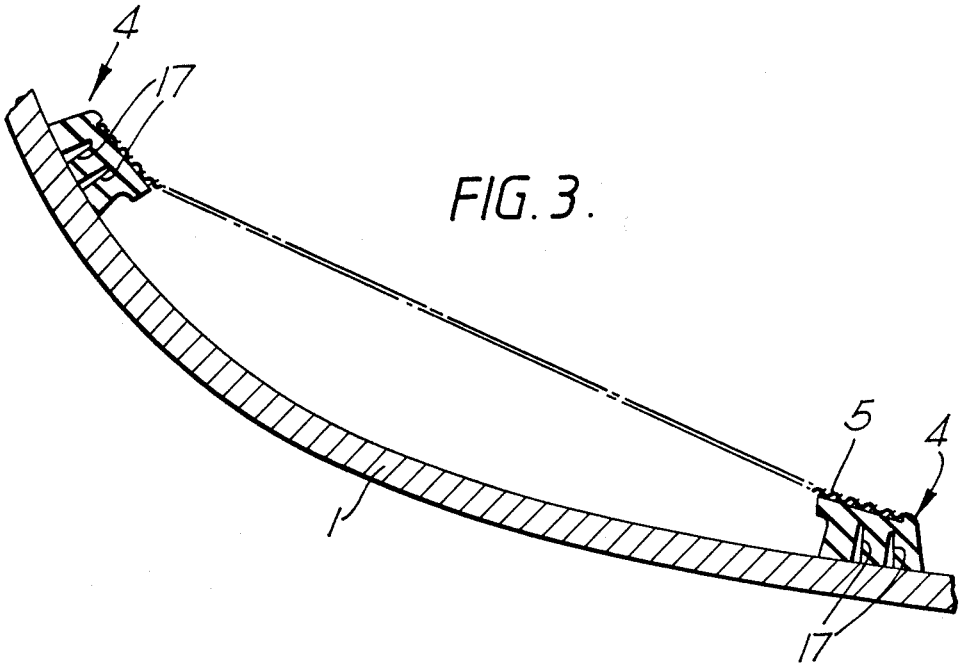
FIG. 3 is a transverse section through a hull mould and a pair of cover edge moulds.
Figure 4:
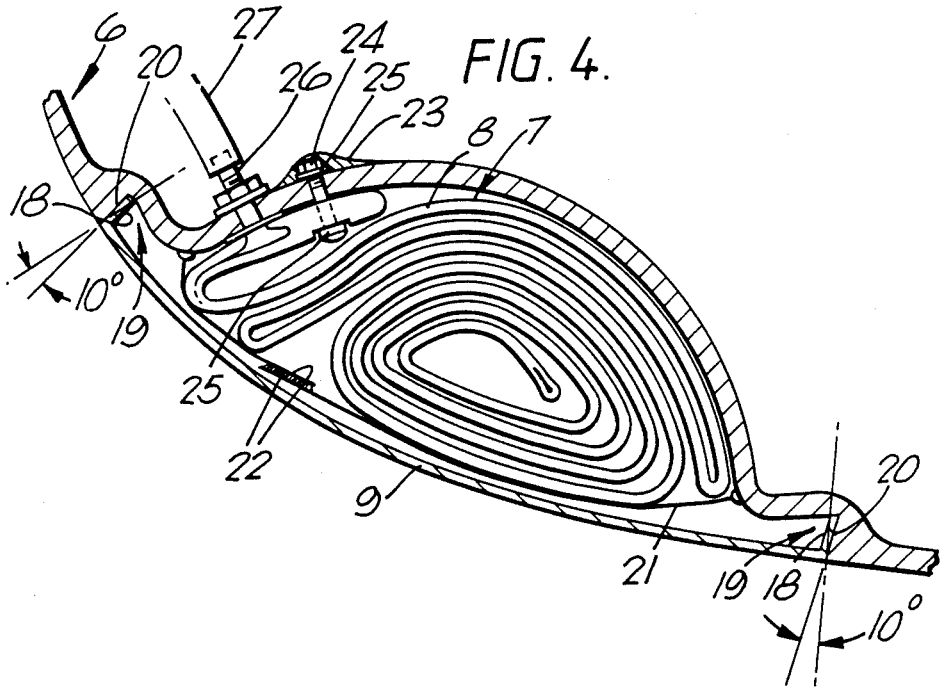
FIG. 4 is a transverse section through part of the moulded hull formed with a recess.
Figure 5:
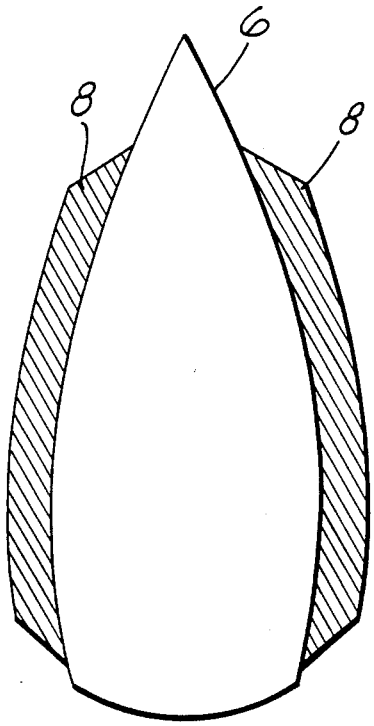
FIGS. 5 and 6 are respectively a section and a plan view of the hull with flotation bags inflated on each side thereof.
Figure 6:
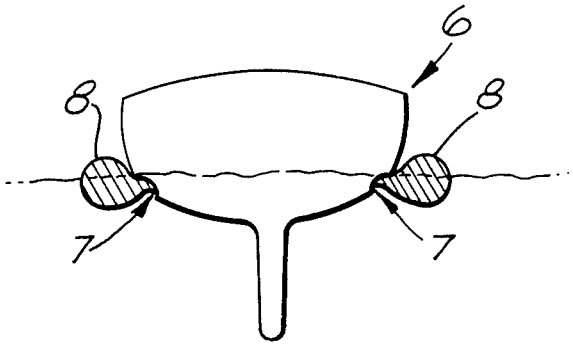

Referring to FIGS. 1 to 3, the equipment required to mould a hull includes a hull mould 1, a recess forming mould 2, an end cap mould 3 for use at each longitudinal end of the mould 2, and a pair of cover edge moulds 4 initially spaced by a fabric spacer 5. Referring to FIGS. 4 to 6 the completed hull 6 is formed with a pair of recesses 7 in each of which is secured a folded inflatable bag 8 and which are each closed by a cover 9.

The recess forming mould 2 has a pair of spaced longitudinal lugs 10 for removable attachment to the bilge section of the hull mould 1. The lugs 10 are connected to the main body 11 of the mould by connecting portions 12 of reduced thickness which enable the lugs to angle themselves to the profile of the hull mould. The lugs include longitudinal slots 13 on their faces which are attached to the hull mould 1 to improve further their ability to adapt to different profiles of hull mould. The upper face of the recess forming mould 2 defines the shape of the recess 7 to be formed and is generally arcuate in transverse section. The mould 2 includes raised lumps 14 to form the recess with location indentations where the moulded hull is to be drilled to receive bag securing bolts.

A pair of longitudinal cavities 15 extend along the length of the recess forming mould 2 to reduce the amount of material used and to improve flexibility. At the ends of the mould 2, the end cap moulds 3 (see FIG. 2) are located by projections 16 which mate with the ends of the cavities 15. The end cap moulds give a rounded shape to the ends of the recess 7.

FIG. 3 shows the pair of cover edge moulds 4 removably attached to the hull mould 1 and spaced by the fabric spacer 5. The moulds 4 include longitudinal slots 17 on their faces which are attached to the hull mould to improve their ability to adapt to the hull mould profile.

The three types of mould 2,3 and 4 of the preferred embodiment are made of a synthetic rubber material resistant to the solvents used in polyester and epoxy resins which are generally used in the construction of fibreglass vessels.

In the completed hull 6 shown in FIG. 4 the recess 7 is closed by the cover 9 which has on each side an inwardly projecting flange 18 arranged to form a clip fit in a correspondingly shaped edge portion 19 of the recess 7. Both the flange and the face 20 of the recess against which it abuts are angled by 10° from the normal to the hull outer surface such that the flanges clip and lock the cover into position. Any inward flexing of the cover caused by external blows will tend to increase the engagement force between the flange 18 and the face 20 so that the cover is retained in position, whereas any outward force on the cover exerted by the inflating bag 8 will flex the cover outwardly and thus reduce the engagement force, the clip fit thereby allowing the cover to be blown away from the recess. Although not illustrated, the join between the hull and the cover is sealed e.g. with a silicone sealant.

The inflatable bag 8, which might be compartmented, is folded within the recess 7 and loosely held folded within the recess 7 by straps 21 connected together by Velcro (trade mark) tabs 22. The bag has a longitudinal attachment flange 23 reinforced by fabric (not shown) and secured to the hull by spaced bolts 24 and a pair of metal strips 25 acting as washers, one on the attachment flange and the other on the hull itself. The inwardly projecting bolt is fibreglassed over to prevent the possibility of leaks when the cover is blown away. A threaded inflation tube 26 is moulded into each compartment of the bag and fitted through a respective hole drilled through the hull. The tubes 26 are each secured by a sealing washer and nut and are each connected via a line 27 to a source of gas. Preferably the gas source is a cylinder (not shown) having a plurality of compartments, one for each inflation tube 26, thus ensuring that a hole in one bag compartment will not result in the loss of gas for other compartments. Each cylinder might contain pressurised gas or chemicals which can he activated to form a gas.

FIGS. 5 and 6 show the bags 8 on each side of the hull when inflated. A hull recess 7 of roughly semi-circular transverse section requires a radius of about 100 mm to contain a bag of about 900 mm diameter when inflated. A pair of bags 6 m in length are sufficient to float a vessel weighing 5 tonnes with a 50 percent safety margin, 5 tonnes being the weight of an average 9 meter yacht or motorboat. Larger recesses and bag may be required for bigger vessels.

The method of moulding the cover 9 and the hull 6 will now be described with reference to FIGS. 1 to 3. The cover edge moulds 4 (FIG. 3) are joined to the fabric spacer by contact glue or film so that they are spaced apart to exactly the width of the recess forming mould 2. This glue does not form a permanent bond to either surface and will allow the parts to be separated when all glue can be removed by wiping with a solvent. After the most suitable position for the location of the recesses has been established in the hull of the vessel, the pair of flexible cover edge moulds 4 are adhered to each side of the hull mould 1 using a contact glue or film. Once the cover edge moulds are glued in position the fabric spacer 5 is peeled away. The hull mould is then marked with a pencil or similar marker so that the recess forming mould 2 can later be located in exactly the same position in the hull mould. Gelcoat (trade mark) is now applied to the area and the cover laid up in the conventional manner after filling sharp corners with a fibre reinforced mineral or similar filler. Once set, the cover and flexible cover moulds are removed from the hull mould, the edges of the cover are dressed to the height formed on it by the cover edge molds, and the cover set aside for fitting later.

The recess forming mould 2 is then attached to the hull mould (FIG. 1) by securing the attachment lugs 10 in the marked position by means of a contact glue or film. Once the recess forming mould is in position, Gelcoat (trade mark) is applied to the hull of the vessel which is then laid up with fibreglass in the conventional manner after filling sharp corners with a fibre reinforced mineral or similar filler. By so forming the cover and the recess on the same hull mould a good fit between the two is ensured.

There may be a number of possible variations to the broad aspects and specific details of the flotation system and it is intended that these be included within the scope of this specification.

I claim:

1. A method of making a boat, comprising moulding a hull with an external longitudinal recess, securing a folded inflatable bag within the recess, and fitting a cover into position over the recess such that it can be blown clear thereof when the bag is inflated to provide buoyancy during an emergency, wherein the hull is moulded with the external longitudinal recess by removably attaching to the inside face of a hull mould an elongate recess forming mould, said recess forming mould being longitudinally flexible so as to be attachable to a variety of different shapes of hull mould, and said recess forming mould being rigid enough to prevent substantial distortion thereof during the moulding of the hull.

2. A method as claimed in claim 1, wherein the recess forming mould has an elongate main body and a longitudinal lug on each side of the main body for removable attachment to the hull mould, the longitudinal lugs being spaced apart from each other by the main body and generally parallel to each other, and the lugs being sufficiently longitudinally flexible to adapt to the longitudinal shape of the hull mould and being flexibly connected to the main body of the recess forming mould such that the lugs can angle themselves to adapt to the transverse shape of the hull mould.

3. A method as claimed in claim 1, further comprising moulding the cover using the same hull mould as is used for the hull, the cover being formed by removably attaching a pair of longitudinally extending cover edge moulds on the inside face of a hull mould at a lateral spacing from each other corresponding to the width of the recess forming mould, the cover edge moulds being shaped such that the moulded cover will fit removably within the recess.

4. A method as claimed in claim 3, wherein each longitudinal edge of the cover is formed as an inwardly directed flange angled to cooperate with the respective edge portion of the recess such that the cover fits forcibly into the recess.

5. A method as claimed in claim 1, wherein the inflatable bag is formed with a longitudinal attachment flange for securing the bag to the hull within the recess, the bag being secured by bolting the flange to the hull with a pair of strips acting as washers, one strip engaging the flange and the other strip engaging the inside of the hull.

6. A kit of parts for making a boat, the kit comprising an elongate recess forming mould for a removable attachment to the inside face of a hull mould to form an external longitudinal recess in a molded hull, the recess-forming mould being longitudinally flexible so as to be usable with a variety of different shapes of hull mould, and the recess-forming mould being rigid enough to prevent substantial distortion thereof during moulding of the hull, the kit further comprising an inflatable bag adapted to be secured in said longitudinal recess, and moulding means for forming a cover adapted to fit over said recess such that the cover can be blown clear of the recess when the bag is inflated to provide buoyancy during an emergency.

7. A kit of parts as claimed in claim 6, wherein the moulding means for forming a cover comprises a pair of elongate cover edge moulds to be removably attached on the inside face of the hull mould at a lateral spacing from each other corresponding to the width of the recess forming mould, the cover edge moulds being shaped such that the moulded cover will fit removably within the longitudinal recess.

8. A recess forming mould adapted to be removably attached on the inside face of a hull mould to provide the desired shape for moulding a hull with an external longitudinal recess, the recess forming mould being elongate and longitudinally flexible so as to be usable with a variety of different shapes of hull mould, and being rigid enough to prevent substantial distortion thereof during moulding of the hull.

9. A recess forming mould as claimed in claim 8, the recess forming mould having an elongate main body and a longitudinal lug on each side of the main body for removable attachment to the hull mould, the longitudinal lugs being spaced apart from each other by the main body and generally parallel to each other, and the lugs being sufficiently longitudinally flexible to adapt to the longitudinal shape of the hull mould and being flexibly connected to the main body of the recess forming mould such that the lugs can angle themselves to adapt to the transverse shape of the hull mould.

* * * * *